US006918428B2

(12) United States Patent
Hauri

(10) Patent No.: US 6,918,428 B2
(45) Date of Patent: Jul. 19, 2005

(54) CHILL TUBE

(75) Inventor: Roland Hauri, Wettswil (CH)

(73) Assignee: KM Europa Metal AG (DE)

( * ) Notice: Subject to any disclaimer, the term of this patent is extended or adjusted under 35 U.S.C. 154(b) by 70 days.

(21) Appl. No.: 10/646,403

(22) Filed: Aug. 22, 2003

(65) Prior Publication Data

US 2004/0069458 A1 Apr. 15, 2004

(30) Foreign Application Priority Data

Aug. 29, 2002 (DE) ..... 102 40 457

(51) Int. Cl.[7] ..... B22D 11/00

(52) U.S. Cl. ..... 164/418; 164/459

(58) Field of Search ..... 164/418, 459

(56) References Cited

FOREIGN PATENT DOCUMENTS

| | | |
|---|---|---|
| JP | 50-154119 | * 12/1975 |
| JP | 56-11149 | * 2/1981 |
| JP | 63-212044 | * 9/1988 |
| JP | 3-118943 | * 5/1991 |
| JP | 9-239496 | * 9/1997 |

* cited by examiner

*Primary Examiner*—Kuang Y. Lin
(74) *Attorney, Agent, or Firm*—Kenyon & Kenyon

(57) ABSTRACT

A chill tube made of copper for the continuous casting of metals has a multi-corner inner and outer cross section and a nominal wall thickness which amounts to 8% to 10% of the separation distance of the inner surfaces lying frontally opposite each other at the tube opening. The inner surfaces are placed indirectly under the heat-removing influence of a cooling medium suppliable from the outside to the tube wall. In the height range of the bath level of the liquid metal, the wall thickness is reduced over the entire circumference by 10% to 40% of the nominal wall thickness.

6 Claims, 2 Drawing Sheets

CHILL TUBE

FIELD OF THE INVENTION

The present invention relates to a chill tube made of copper for the continuous casting of metals.

BACKGROUND INFORMATION

Chill tubes are known to have rectangular inner and outer cross sections, as well as having rounded longitudinal edge regions which have a nominal wall thickness that is 8% to 10% of the distance between the inner surfaces lying frontally opposite to each other at the tube opening.

Moreover, it is known for chill tubes that one may put the inner surfaces indirectly under the influence of cooling media that remove heat and are able to be supplied to the tube wall from the outside. In this connection, the chill tubes may be furnished on their outer contours with fitted jackets, which form exactly specified gaps together with the outer surfaces of the chill tubes, through which cooling media may be conducted. The cooling media may also flow through cooling channels put vertically into the walls of the chill tubes. Finally, it is also known that one may apply cooling media to the outer surfaces of the chill tubes via spray nozzles.

In the course of practical efforts to increase casting speeds, namely to rates greater than 2.5 m/min, the then-existing heat may only still be transferred partially to the cooling media removing the heat, on account of the limited heat transfer capacity of the basic materials of the chill tube. The result is partial overheating and, in this context, damage to the inner surfaces of the chill tubes. This circumstance may be observed especially in the high ranges of the bath levels which vary in their level, and in the region of the first phases of primary solidification of the metals to be cast, because in those locations there prevails the greatest heat supply to the chill material.

SUMMARY

The present invention is based on the object of creating a chill tube made of copper for the continuous casting of metals, which ensures, particularly at casting speeds greater than 2.5 m/min, a flawless conduction of heat from the metal to be cast to a cooling medium.

This object is attained by a chill tube made of copper for the continuous casting of metals, which has a rectangular inner and outer cross section having rounded longitudinal edge regions (2) as well as a nominal wall thickness (WD), which amounts to 8% to 10% of the separation distance (A) between the inner surfaces (5) lying facing each other frontally at the tube opening (4), the inner surfaces (5) being placed indirectly under the heat-removing influence of a cooling medium suppliable from the outside to the tube wall (2, 3), wherein the wall thickness (WD1) in the longitudinal edge regions (2) is dimensioned to be 10% to 40% less than the wall thickness (WD) of the wall regions (3) between the longitudinal edge regions (2). As an alternative to the above, the object may be achieved by a chill tube made of copper for the continuous casting of metals, which has a multi-corner or round inner and outer cross section as well as a nominal wall thickness (WD3) which amounts to 8% to 10% of the separation distance (A2) between the inner surfaces **(5*a*) lying frontally opposite each other at the tube opening (4*a*) or the inner diameter at the tube opening, the inner surfaces (5*a*) being placed indirectly under the heat-removing influence of a cooling medium suppliable from the outside to the tube wall (16), wherein in the height range (14, 15) of the bath level of the liquid metal, the wall thickness (WD2) is reduced over the entire circumference by 10% to 40% of the nominal wall thickness (WD3**).

In accordance with a first alternative solution of the present invention, the wall thickness of the rectangular chill tube in the longitudinal edge region is now dimensioned to be 10% to 40% less than the wall thickness between the longitudinal edge regions. This measure sees to it that, even at casting speeds >2.5 m/min, the heat that arises may be flawlessly transferred to the respective cooling medium, and to be sure, independent of whether a cooling medium is now conveyed in a gap between a chill tube and a jacket surrounding the chill tube, whether the cooling medium flows in cooling channels in the wall of a chill tube or whether the outer surfaces of a chill tube are sprayed directly with a cooling medium.

The wall thickness in the longitudinal edge regions may be dimensioned to be 25% to 30% smaller than the wall thickness between the longitudinal edge regions.

The wall thickness reduction may extend over the entire length of the chill tube.

However, it is also conceivable, depending on respective local conditions, that, the wall thickness reduction in the longitudinal edge regions is limited to a height range in which the respective bath level of the liquid metal lies.

In accordance with a second solution alternative, the wall thickness of the chill tube is reduced over the entire circumference to 10% to 40% of the nominal wall thickness in the height range of the bath level of the liquid metal. The cross section of the chill tube may have multiple corners, such as being rectangular, or it may be round.

Here too, the wall thickness may be reduced by 25% to 30% of the nominal wall thickness.

The bath level in the chill tube may be in a height range which extends from the filling front face to approximately 500 mm from the filling front face.

According to experience, the height level of the bath level may be between 80 mm and 180 mm below the filling end face.

BRIEF DESCRIPTION OF THE DRAWINGS

The present invention is explained in detail below, using an exemplary embodiment represented in the drawings.

DETAILED DESCRIPTION

Figure 1:
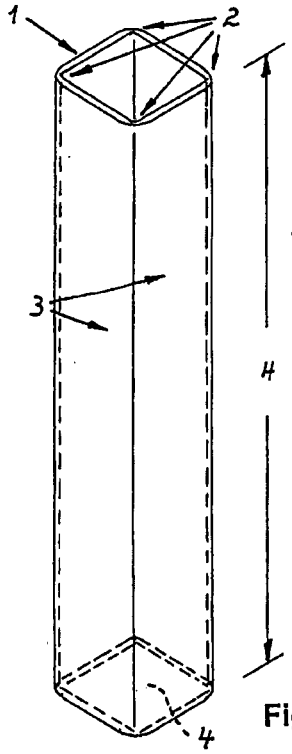
FIG. 1 is a perspective view of a chill tube.
Figure 2:
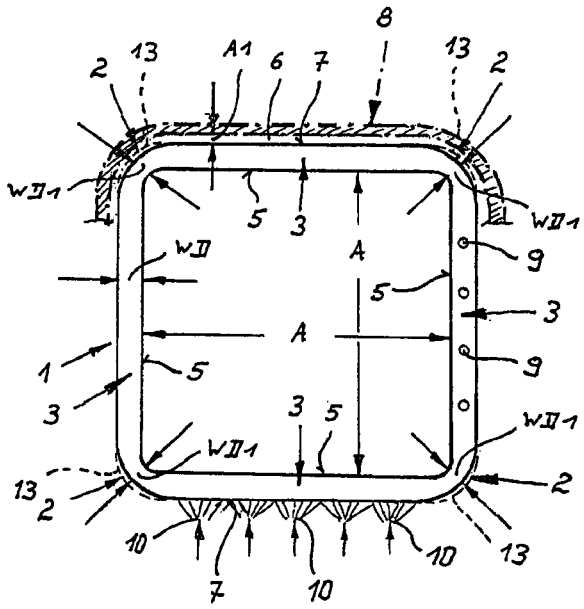
FIG. 2 is a top view, on a larger scale, of the chill tube of FIG. 1 showing three different cooling variants.

In FIGS. 1 and 2, reference numeral 1 denotes a chill tube made of copper for the continuous casting of metals, especially steel.

Chill tube 1 has a rectangular inner and outer cross section having inner and outer rounded longitudinal edge regions 2. The so-called nominal wall thickness WD of wall regions 3 between longitudinal edge regions 2 amounts to 8% to 10% of the distance A between inner surfaces 5 which lie frontally facing each other at tube opening 4.

Wall thickness WD1 in longitudinal edge regions 2 is dimensioned to be 10% to 40% less than wall thickness WD in wall regions 3 between longitudinal edge regions 2.

The different wall thicknesses WD and WD1 of chill tube 1 in FIGS. 1 and 2 are present over the entire height H (length) of chill tube 1.

According to a first specific embodiment indicated in FIG. 2, the cooling of chill tube 1 may be performed by a cooling medium which flows through a gap 6 that is formed between outer surface 7 of chill tube 1 and a jacket 8, which encases chill tube 1 at a specific distance A1.

A second specific embodiment, illustrated in FIG. 2, provides longitudinal channels 9 introduced into the wall regions 3 of chill tube 1, to which a suitable cooling medium is applied.

Finally, FIG. 2 illustrates another specific embodiment of a cooling method in which the outer surfaces 7 of chill tube 1 are cooled in partial regions or overall, using a cooling medium which is sprayed onto these surfaces 7 from nozzles 10.

Figure 3:
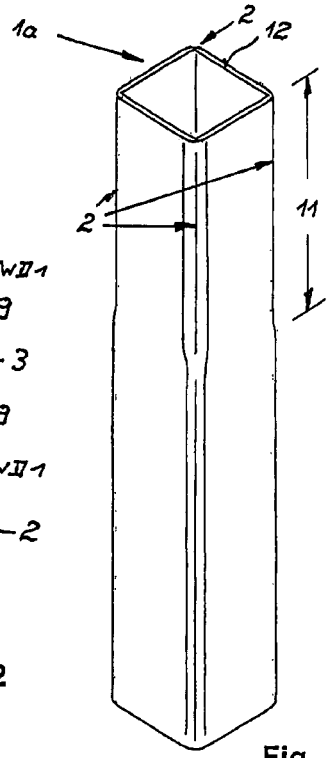
FIG. 3 is a perspective view of a further specific embodiment of a chill tube.

FIG. 3 illustrates a chill tube 1 made of copper for the continuous casting of metals, in which the wall thickness reduction in the longitudinal edge regions 2 is limited to a height range 11, in which the level of the bath level of the liquid level, is located. This height range 11 extends, as a rule, between filling end face 12 of chill tube 1*a* and a region which lies about 500 mm below filling end face 12.

The cooling of chill tube 1*a* may be performed as performed in the cooling of chill tube 1. That being the case, there is no need to repeat the explanation.

Looking at FIGS. 2 and 3 together, the wall thickness reduction takes place in longitudinal edge regions 2. The original course of the outer circumference of chill tube 1*a* in the lower height range is illustrated in FIG. 2 in a broken line direction 13.

Figure 5:
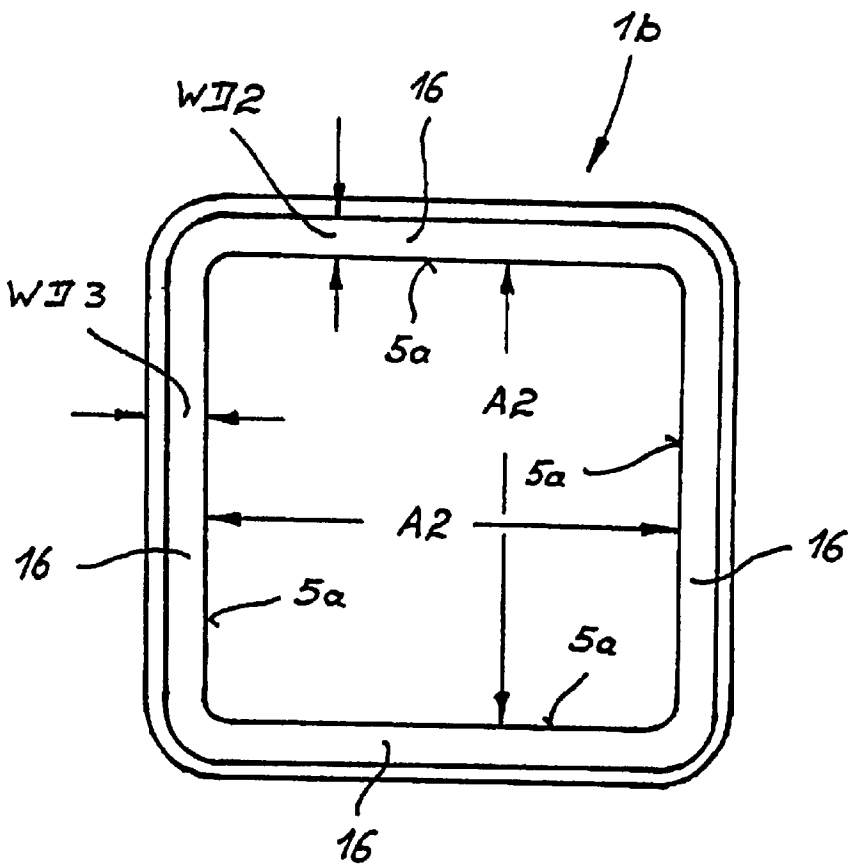
FIG. 5 is a top view of the chill tube in FIG. 4 on an enlarged scale.
Figure 4:
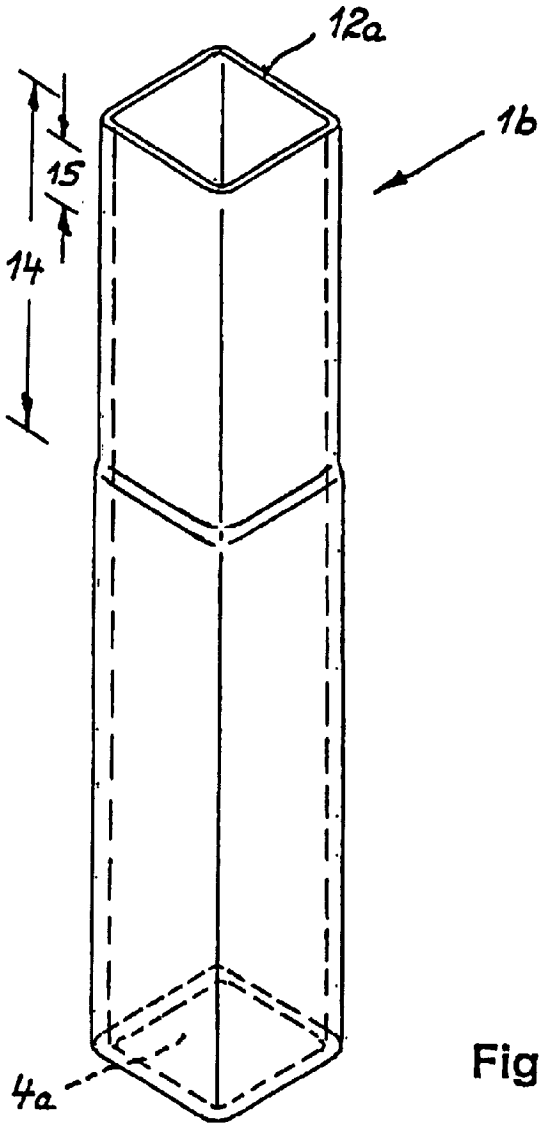
FIG. 4 is a perspective view of a third specific embodiment of a chill tube.

In the specific embodiment of a chill tube 1*b* made of copper for the continuous casting of metals according to FIGS. 4 and 5, in height range 14 of the bath level of the liquid metal, wall thickness WD2 of tube wall 16 is reduced over the entire circumference to 10% to 40% of nominal wall thickness WD3. This height range 14 extends starting from the filling end face 12*a* about 500 mm in the direction towards tube opening 4*a*. The bath level as such mostly lies in a height range 15 between 80 mm and 180 mm below filling end face 12*a*.

In this specific embodiment too, nominal wall thickness WD3 amounts to 8% to 10% of the distance A2 between inner surfaces 5*a* lying frontally opposite each other at tube opening 4*a*.

The specific embodiment of FIGS. 4 and 5 of a chill tube 1*b* may be cooled as was explained in the light of FIG. 2. This being the case, we may do without describing it once again.

LIST OF REFERENCE NUMERALS

1—chill tube
1*a*—chill tube
1*b*—chill tube
2—longitudinal edge regions of 1
3—wall areas between 2
4—tube opening of 1
4*a*—tube opening of 1*b*
5—inner surfaces of 1
5*a*—inner surfaces of 1*b*
6—gap between 7 and 8
7—outer surfaces of 1
8—jacket around 1
9—longitudinal channels in 3
10—nozzles
11—height range of 1*a*
12—filling end face of 1*a*
12*a*—filling end face of 1*b*
13—course taken by circumference
14—height range of 1*b*
15—height range of 1*b*
16—tube wall of 1*b*
A—separation distance of 5
A1—separation distance of 7 and 8
A 2—separation distance of 5*a*
H—height of 1
WD—nominal wall thickness of 3
WD1—wall thickness of 2
WD2—wall thickness of 14
WD3—nominal wall thickness of 1*b*

What is claimed is:

1. A chill tube made of copper for a continuous casting of metals, comprising:

a rectangular inner and outer cross section having rounded longitudinal edge regions as well as a nominal wall thickness, which amounts to 8% to 10% of a separation distance between inner surfaces lying facing each other frontally at a tube opening, the inner surfaces being placed indirectly under a heat-removing influence of a cooling medium suppliable from an outside to the tube wall, wherein the wall thickness in the longitudinal edge regions is dimensioned to be 10% to 40% less than the wall thickness of wall regions between the longitudinal edge regions.

2. The chill tube according to claim 1, wherein the wall thickness in the longitudinal edge regions is dimensioned to be 25% to 30% less than the wall thickness in the wall regions between the longitudinal edge regions.

3. The chill tube according to claim 1, wherein the wall thickness is reduced in the longitudinal edge regions and is limited to a height range, in which a level of a bath level of liquid metal lies.

4. The chill tube according to claim 3, wherein the bath level in the height range lies up to 500 mm below a filling end face.

5. The chill tube according to claim 3, wherein the bath level in the height range lies between 80 mm and 180 mm below a filling end face.

6. The chill tube according to claim 2, wherein the wall thickness is reduced in the longitudinal edge regions and is limited to a height range, in which a level of a bath level of liquid metal lies.

* * * * *